US006679375B1

(12) United States Patent
Coory

(10) Patent No.: US 6,679,375 B1
(45) Date of Patent: Jan. 20, 2004

(54) DISCHARGE CAP FOR RELEASABLE PRODUCT

(76) Inventor: Fredrick Michael Coory, 1 Dymock Place, Christchurch (NZ)

( * ) Notice: Subject to any disclaimer, the term of this patent is extended or adjusted under 35 U.S.C. 154(b) by 0 days.

(21) Appl. No.: 09/831,437

(22) PCT Filed: Nov. 9, 1999

(86) PCT No.: PCT/NZ99/00185

§ 371 (c)(1),
(2), (4) Date: May 9, 2001

(87) PCT Pub. No.: WO00/27717

PCT Pub. Date: May 18, 2000

(30) Foreign Application Priority Data

Nov. 9, 1998 (NZ) ..... 332745
May 4, 1999 (NZ) ..... 335575

(51) Int. Cl.[7] ..... B65D 25/08

(52) U.S. Cl. ..... 206/219; 206/222; 215/DIG. 8; 222/80

(58) Field of Search ..... 206/216–222, 206/568; 222/135, 136, 82, 80, 129, 129.1; 215/DIG. 8, 10

(56) References Cited

U.S. PATENT DOCUMENTS 3,156,369 A * 11/1964 Bowes et al. ..... 206/222
3,347,410 A 10/1967 Schwartzman
4,638,927 A 1/1987 Morane
4,793,475 A * 12/1988 Itzel ..... 206/221
4,884,705 A 12/1989 Debetencourt
5,104,008 A 4/1992 Crisci
5,543,097 A * 8/1996 Fang ..... 264/102
5,811,060 A * 9/1998 Laguna Valderrama ..... 422/102
5,853,109 A 12/1998 Elliott
5,971,140 A * 10/1999 Frutin ..... 206/222
6,138,821 A * 10/2000 Hsu ..... 206/222
6,152,296 A * 11/2000 Shih ..... 206/222
6,230,884 B1 * 5/2001 Coory ..... 206/222

FOREIGN PATENT DOCUMENTS

| | | |
|---|---|---|
| AU | 199959309 A1 | 5/2000 |
| DE | 29800794 | 3/1998 |
| FR | 2 290 366 | 6/1976 |
| JP | 08091418 | 4/1996 |
| WO | WO98/00348 | 1/1998 |
| WO | WO98/40289 | 9/1998 |

* cited by examiner

*Primary Examiner*—Mickey Yu
*Assistant Examiner*—Jila M. Mohandesi
(74) *Attorney, Agent, or Firm*—Greer, Burns & Crain, Ltd.

(57) ABSTRACT

A cap for a container, for a drink of two components, can be stored or carried with the components stored separately. Mixing prior to consumption is effected by a pushing device incorporated into a cover on the cap, which cover is releasably secured to the container. The pushing device bears against a tablet holder the base of which has a low burst of strength. The pushing device can be one of a number of embodiments, all of which can operate with or without an annular cutting ring and flexible seal adjacent the underside of the tablet holder. The cover and tablet holder form a liquid seal with the top of the container until the cover is removed.

23 Claims, 11 Drawing Sheets

DISCHARGE CAP FOR RELEASABLE PRODUCT

TECHNICAL FIELD

The present invention relates to a cap for a container, in which the cap includes means for releasing material contained within the cap into the container and for sealing the container.

BACKGROUND ART

Different styles of caps or lids for containers (for liquids) are prolific. They are known in a variety of forms, which can include, for example: a tamper-evident ring, the ability to be releasable, a screw-thread, or a combination of these. Such caps can also include sipper tops (which can be drunk through and are slidably resealable).

Drinks and drink containers where two components making the drink are best mixed immediately before drinking are available separately. When the concentrate is in tablet or powder form, the availability of drink containers with all elements for the drink in the one container is not common. One example of such a cap for a container is in my application, WO 98/40289.

Other examples include the following. WO 98/00348 discloses a closure cap which ruptures a blister pack (containing a tablet) on the opening of the cap, and provides an immediate fluid pathway to the outside of the container. JP 08091418 also disclosures a closure cap and basket. However the whole of the closure cap must be moved inwardly onto the container, to mix the liquid and the solid together.

U.S. Pat. No. 4,638,927 (Morane) discloses a cap with a slidable pusher to break the tablet holder. However, this action immediately creates a fluid pathway to the outside of the container. This also occurs in U.S. Pat. No. 3,347,410 (Schwartzman).

These problems are to some extent overcome by the invention disclosed in my application WO 98/40289. This discloses a cap with a collar, a basket containing the solid part of the drink, and a spike, formed in the cap, which can release the tablet into the fluid in the bottom of the container. The container and cap also include the ability of the cap to act as a sipper top, and to include a separate cover and tamper-evident ring.

The disadvantage of this manner of overcoming the drawbacks of earlier art is the complexity of the design and the die needed for the manufacture of the neck portion (to pierce the top and free the tablet into the fluid). Further, the overall height of the cap above the container can be awkward. In addition, the sealing of the container, either when mixing the fluid and solid or when the container is not in use after mixing, requires an arrangement of two sealing means or a sliding engagement of two or more parts.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a cap for a liquid container with a top opening, said cap including:

a tablet holder which includes a flanged flat edge which is capable of being heat sealed or glued to other materials; a flexible top; a base of flexible material, said base having a burst strength which is less than that of said top; wherein the flanged edge, the top and the base are capable of lamination; and wherein the top and the base are spaced apart, forming a space for the placement therebetween of a tablet;

a collar with means to releasably engage with the top of the container, said collar including a flange for releasably retaining said flanged edge of the tablet holder between the collar and the top of the container, forming a fluid seal therebetween;

a cover which is releasably securable to the collar; and pushing means capable of manual operation to push the top of the tablet holder inwards into the container, when the tablet holder is in position; wherein the top of the tablet holder provides part of the fluid seal once the burst strength of the base is exceeded on application of force to the pushing means; and wherein said tablet holder and collar are releasably removable from the container.

In a further aspect of the present invention there is provided a cap for a liquid container with a top opening, as described above, in which the pushing means is integrally formed with the cover, and may include a centrally located area of reinforcement or stiffening, or a shaped area of increased strength on the top of the cover. Optionally, said pushing means may be incorporated as a tear away area of the top of the cover which can be released from the cover and pushed down onto the top of the tablet holder in one action.

A further option is to incorporate the pushing means in the collar, forming a dome across the central portion of the collar.

Optionally the tablet holder may be formed with the base and the edge being flat and planar; and the top being raised above the edge. Further, optionally, the tablet may be sealed in-between two layers of highly flexible foil (or foil and plastic) to form a package. The edges of the package are heat sealed to the flanged edge of the holder.

In a still further aspect of the present invention there is provided a cap for a liquid container with a top opening, as described above, in which the pushing means is integrally formed with the cover, said pushing means including:

a hinged portion of the top of the cover, said hinged portion comprising: a partially cut away section, being from the top of the cover; and two sections, one of which is a straight section of the top of the cover, which straight section is flexible and acts as a hinge means for the hinged portion, and a cut-away section which section is resiliently moveable; and an operative portion, which includes digit-engaging means, and which portion is positioned over the cut-away section of the hinged portion, said operative section being moveable between a first and a second position, the second position being one in which pressure is applied through the cut-away portion, to the top of the tablet holder.

Preferably, the digit-engaging means is in the form of a circular tab which is elevated above the top of the cover by a columnar support. Also preferably, the cut-away section is substantially straight-sided with a circular balloon-style end portion which is immediately underneath the digit-engaging means.

Optionally the shape of the cut-away can be selected from: straight sided with a balloon-style end portion; parallel arcuate sides; non-parallel straight sides; non-parallel arcuate sides; and a combination thereof.

In a yet further aspect of the present invention there is provided a cap for a liquid container with a top opening, as described above, in which the cap further includes a cutting ring which is annular and positioned between the top of the container and the flanged edged of the tablet holder. Preferably also, said cutting ring has an inner edge adapted to cut and/or break the base of the tablet holder.

Preferably also, said cap further includes a flexible annular seal between the top of the container and the flanged edge. Optionally, the annular seal and the cutting ring are formed integrally, when both options form part of the cap.

Optionally the base of the tablet holder includes a circular area positioned adjacent and inward of the flanged edge, which circular area is an area of reduced burst strength relative to that of the remainder of the base. Optionally, there is included in the cap a further circular flexible seal which is positioned below and spaced apart from the base of the tablet holder, said seal being of a material of low burst strength, such that the tablet or cut-away section, when bearing down on said seal, causes the seal to burst.

Optionally, the cap or the cap and container further includes tamper evident means. Such means is of known type and, for example, includes a collar of plastic material around the seal between the cover and the container, or optionally could be incorporated into the cover.

Preferably, the cover is formed from plastics, integrally, by a method selected from: injection moulding, comoulding, blow moulding; and a combination of these. Preferably all other parts (except the tablet) are of a plastics material or incorporate plastics; Preferably the tablet is of known type that effervesces and dissolves quickly when in liquid.

Optionally the cap can include a sipper top or other means to evacuate the fluid from the container (once the two parts are mixed), which can be secured to the container after the removal of the collar and holder remains.

BRIEF DESCRIPTION OF DRAWINGS

By way of example only, preferred embodiments of the present invention will be described in detail with reference to the accompanying drawings, in which.

BEST MODES FOR CARRYING OUT THE INVENTION

Figure 2:
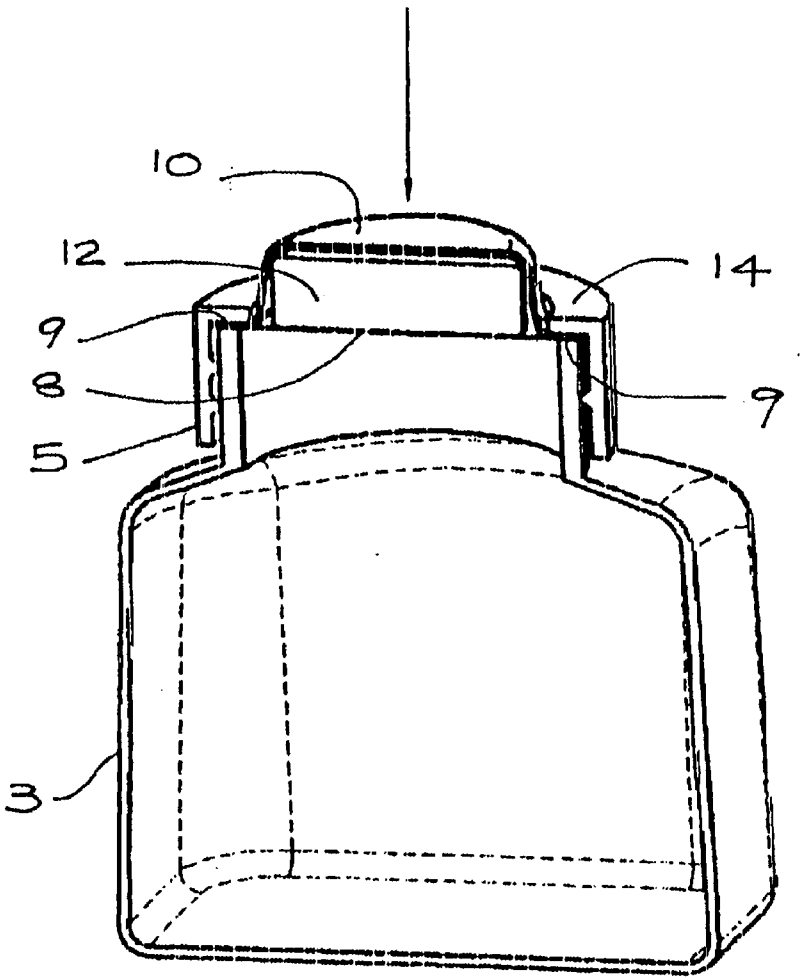
FIG. 2 is the same view of the invention as shown in FIG. 1, without the cover.
Figure 1:
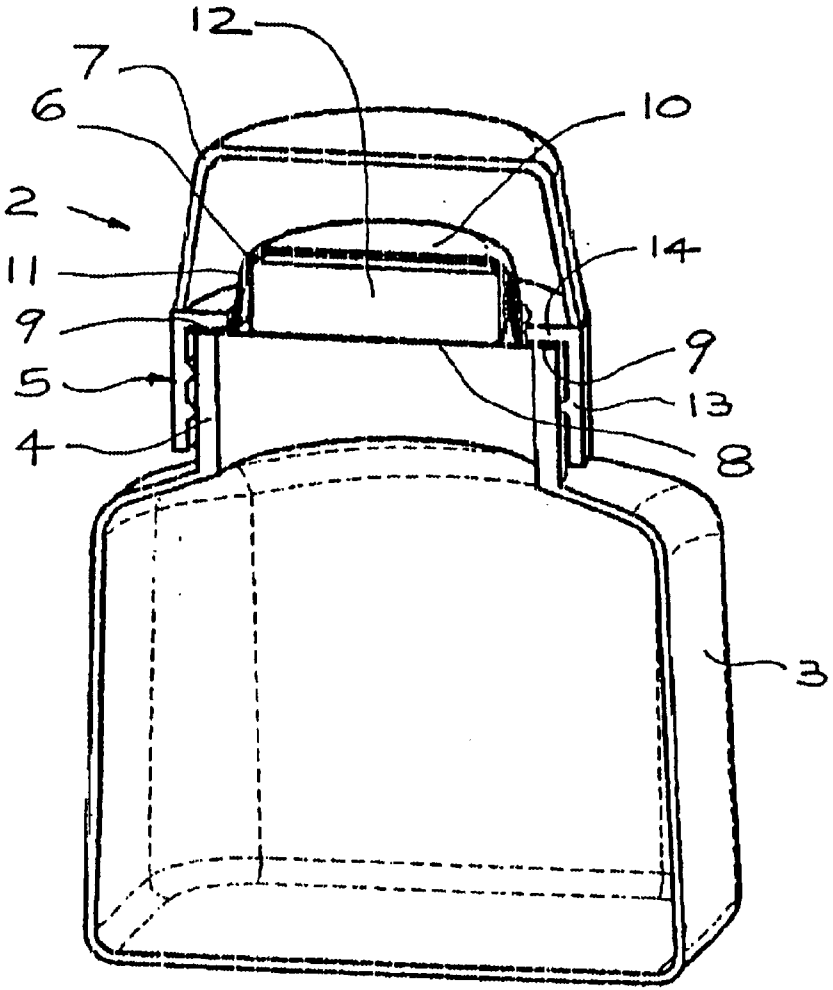
FIG. 1 is a partial perspective side section view of a first preferred embodiment of the present invention with the cap closed.
Figure 3:
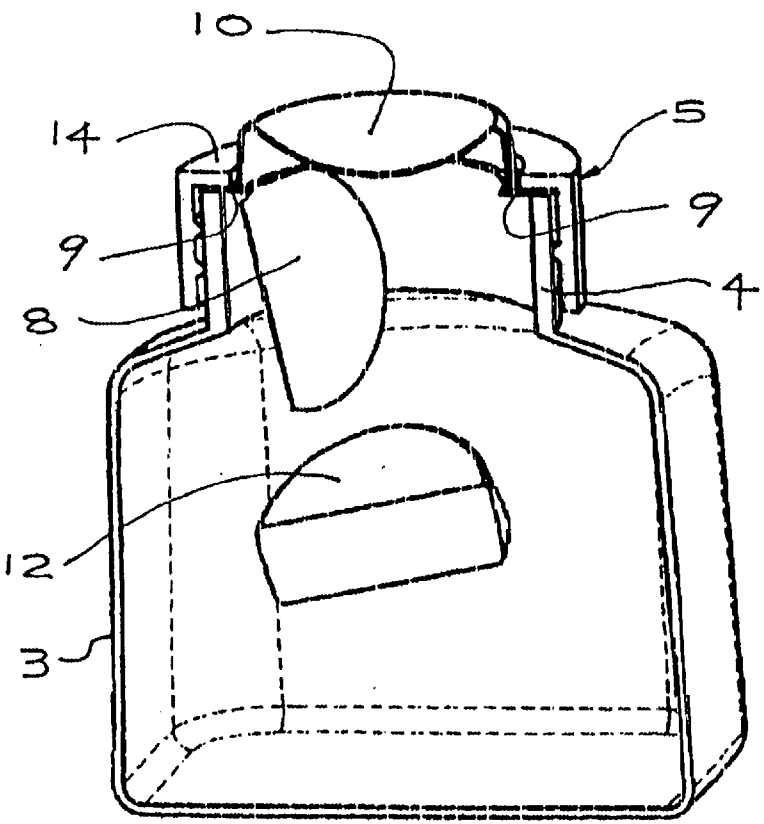
FIG. 3 is the same view as shown in FIG. 2, with the tablet holder broken and the tablet in the container.
Figure 6:
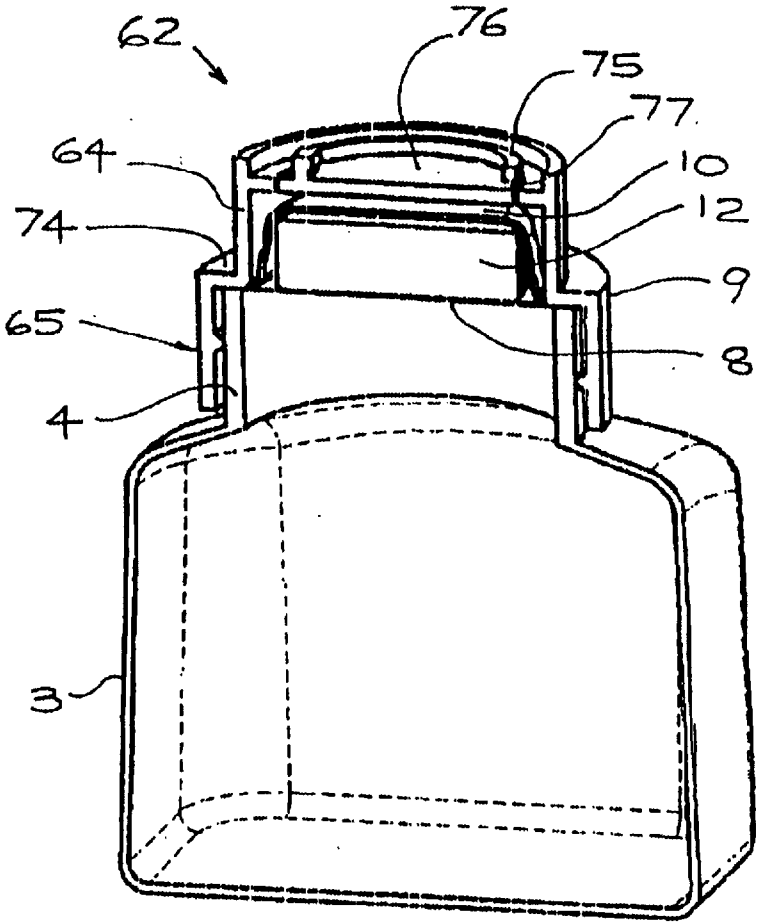
FIG. 6 is a partial perspective side section view of a third preferred embodiment of the present invention with the cap closed.

Referring to FIGS. 1 to 3, a first preferred embodiment of the cap 2 for a container 3 is thereshown. The container 3 includes a top opening with external screw threads on sides 4. A collar 5 is internally screw-threaded to engage with the sides 4 of the container 3. The cap 2 includes a tablet holder 6 and cover 7.

The holder 6 includes a base 8 with a thickened circumferential edge 9, and a top 10. The base 8 and edge 9 are flat, with the top 10 having sides 11. The base 8, top 10, and sides 11 define a space for a tablet 12. The base 8 is of a material that has a considerably smaller burst strength than that of the top 10 or the sides 11. The base 8 is made of a foil material of known type which is impervious to liquid and gases. If so desired, the foil may included a plastic film of known type.

If so desired, the holder 6 may be arranged with the base 8 and top 10 inverted, so that the top 10 is flat and approximately co-planar with the edge 9. The base 8 and sides 11 would then extend downwardly from the top 10.

The edge 9 and the top 10 are of a plastics material that is generally stiffer than the material of the base 8. However the base 8 is also constructed so that there is a measure of flexibility therein.

The collar 5 includes sides 13 and a smaller annular flange 14. When the collar 5 is in position the flange 14 extends inwardly of the top of the sides 4 and of the edge 9. However the hole left in the collar 5 is sufficient that the sides 11 and the top 10 of the holder 6 will fit therethrough.

The cover 7 is shaped to fit over the collar 5 and holder 6 and be releasably securable to the collar 5. This securement can be through securing means on the collar 5 and the cover 7; or may be in the form of a snap or interference fit between the collar 5 and the cover 7, as is desired. Further, the cover 7 may be hinged to the collar 5, if so desired.

The collar 5 and the cover 7 may include tamper-evident means (not shown) of known type, if so desired. This may be incorporated into the collar 5 and cover 7 at the time of manufacture. Alternatively, the tamper evident means may be a plastic film (not shown) which is sealed around the collar 5 and the cover 7, covering the join therebetween. Such film is of the type that can be pulled off the container 3, when opening the container 3.

To mix the two parts of the drink, the cover 7 is removed and downward force exerted on the top 10 (FIG. 2). This downward pressure is generally supplied by a thumb or other manual means. The lesser burst strength of the base 8 causes this to break before the top 10. The flange 14 retains the edge 9 in position. Thus after the base 8 has broken, the tablet 12 is forced or dropped into the container 3, mixing with the liquid therein (FIG. 3).

If so desired, the base 8 includes a weakened circumferential portion immediately adjacent the outside edge of the tablet 12. Thus when the burst strength of the base 8 is reached, a circular portion of the base 8 parts from the rest of the base 8, allowing the tablet 12 to easily fall into the container 3.

If so desired, the holder 6 can be constructed so that the tablet 12 is encased in the foil of the base 8 with a circular overlap about the outside of the tablet 12. This overlap is then heat sealed or otherwise laminated to the edge 9 to form the holder 6.

Figure 4:
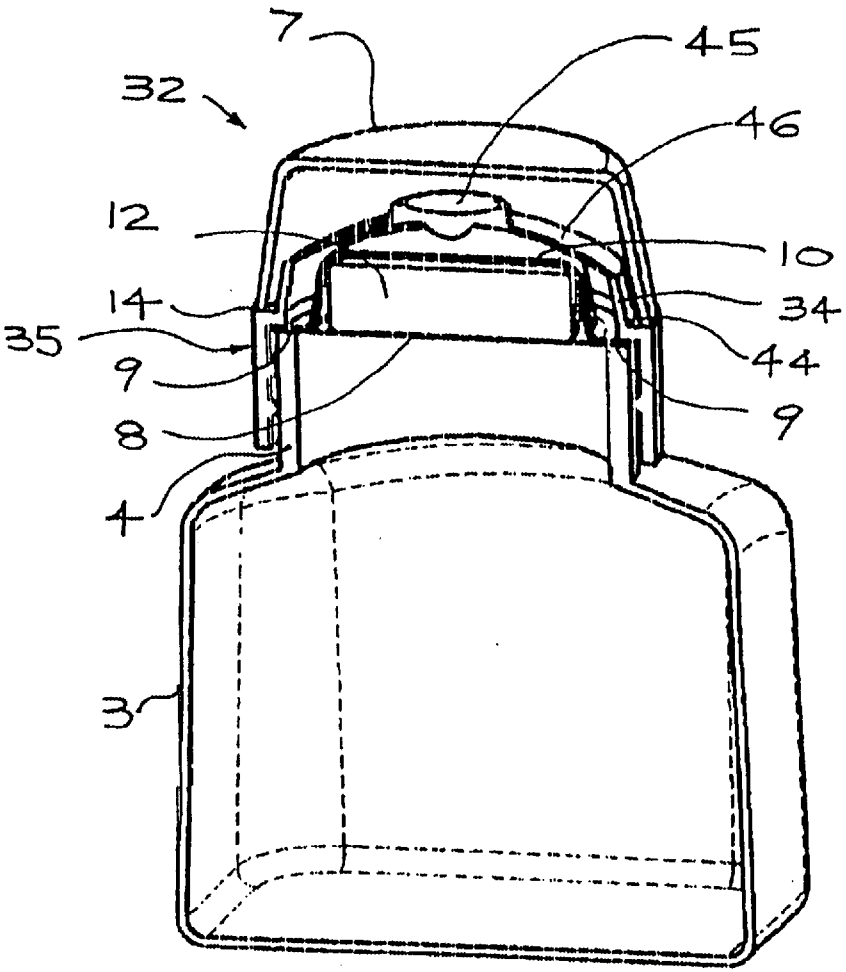
FIG. 4 is a partial perspective side section view of a second preferred embodiment of the present invention with the cap closed.

The container 3 can be shaken or moved to aid in the mixing of the tablet 12 into the liquid. Once the tablet 12 is completely dissolved, the collar 5 and the remains of the holder 6 can be released from the container 3, allowing access to the drink (FIG. 4). The collar 5 and the cover 7 may be re-secured to the container 3, providing for a means to reseal the drink, if so desired.

Figure 5:
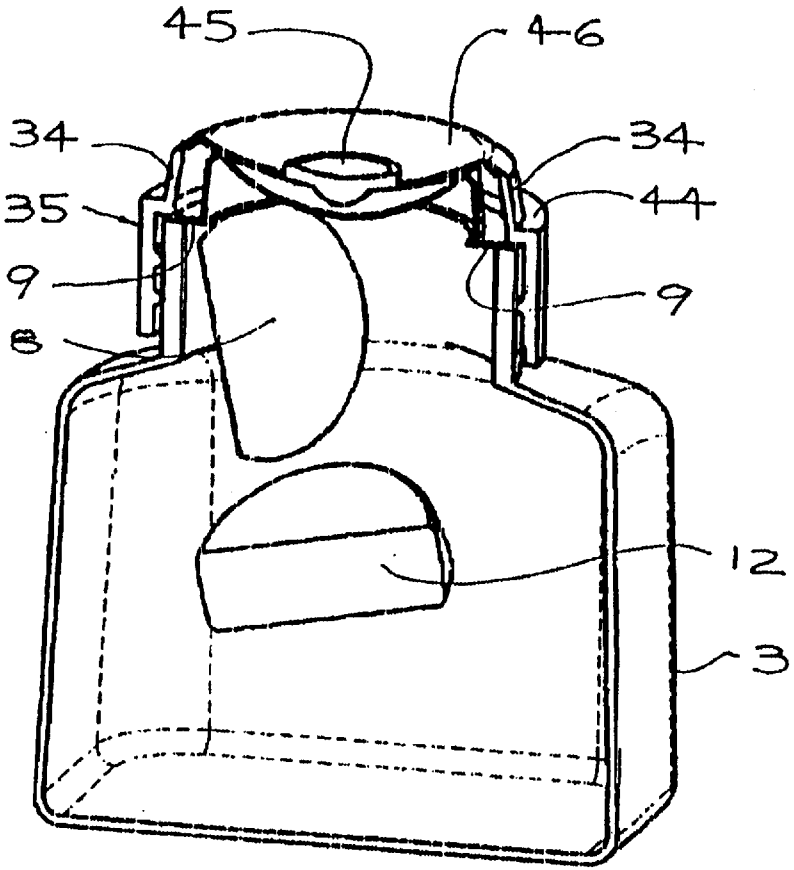
FIG. 5 is the same view as FIG. 4, with the tablet holder broken and the tablet in the container.
Figure 8:
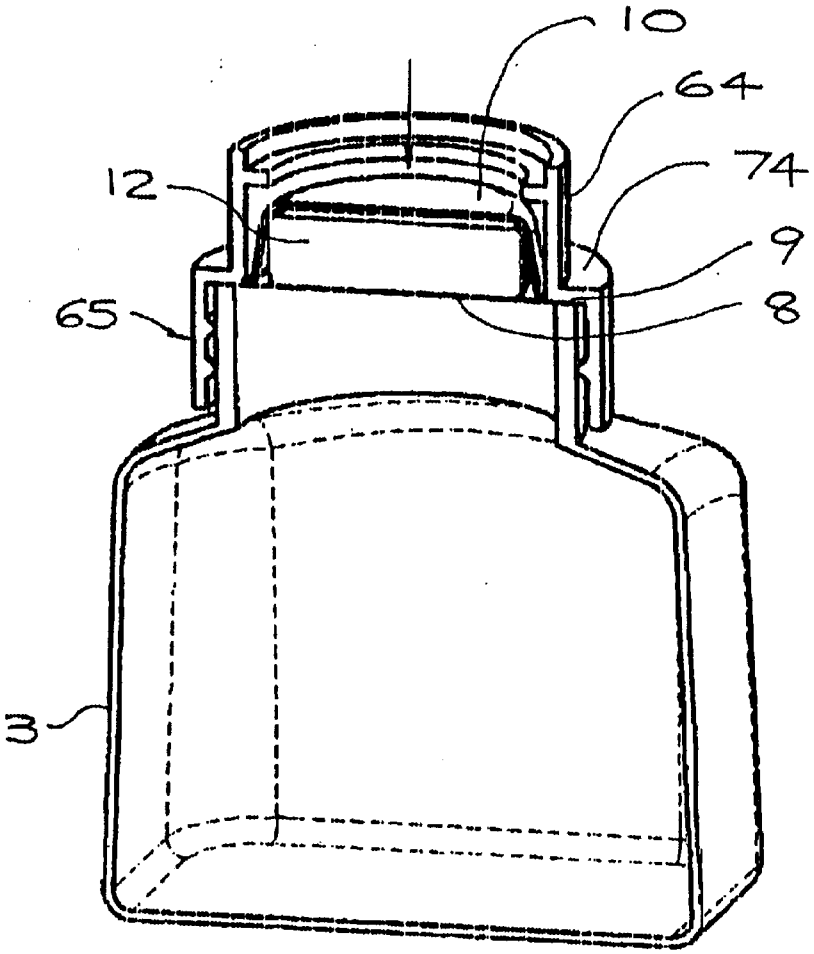
FIG. 8 is the same view as FIG. 7, with the ring removed.

Referring to FIGS. 4 and 5, a second embodiment of the cap 32 for the container 3 is thereshown. Where parts are unchanged from that discussed above with reference to the first embodiment, like numerals are used.

The collar 35 includes a flange 44 and upper sloping side 34 to a domed top 46. At the centre of the top 46 is a button 45. The collar 35 is formed integrally. The flange 44 performs the same function as the flange 14 of the first embodiment, as described above.

To mix the two parts of the drink, the cover 7 is removed and downward force exerted on the button 45 (FIG. 5). This downward pressure is generally supplied by a thumb or other manual means. The lesser burst strength of the base 8 causes this to break before the top 10. The flange 44 retains the edge 9 in position. Thus after the base 8 has broken, the tablet 12 is forced or dropped into the container 3, mixing with the liquid therein (FIG. 5).

The container 3 can be shaken or moved to aid in the mixing of the tablet 12 into the liquid. The liquid seal is provided by the edge 9 and the top 10 of the tablet holder 6, which is retained in position by the collar 35. Once the tablet is completely dissolved, the collar 35 and the remains of the holder 6 can be released from the container 3, allowing access to the drink. The collar 35 and the cover 7 may be re-secured to the container 3, providing for a means to reseal the drink, if so desired.

Referring to FIGS. 6 to 9, a third embodiment of the cap 62 for the container 3 is thereshown. Where parts are unchanged from that discussed above with reference to the first embodiment, like numerals are used.

The collar 65 includes a flange 74 and upper side 64 to a flat top 76. A ring of material 75 around the centre of the top 76 is immediately adjacent a breakaway portion 77. The portion 77 is a weakened portion of the top 76. The collar 65 is formed integrally. The flange 74 performs the same function as the flange 14 of the first embodiment, as described above.

Figure 7:
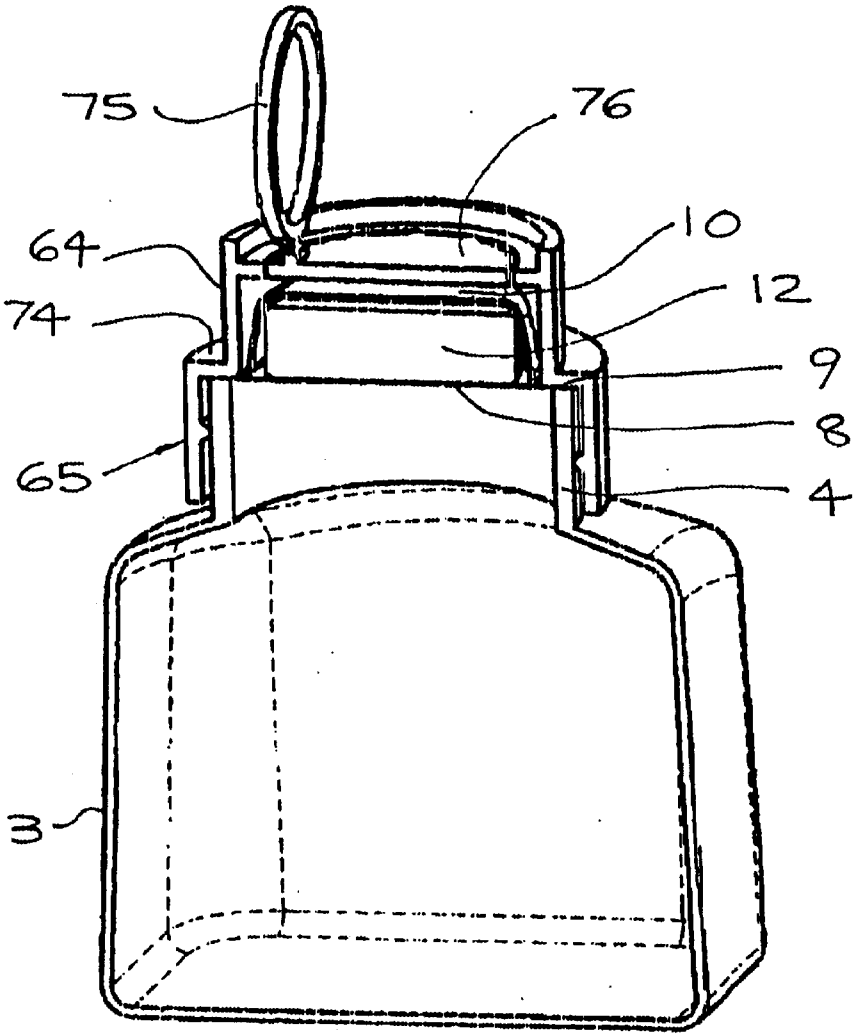
FIG. 7 is the same view as FIG. 6 with the tamper-evident ring opened.
Figure 9:
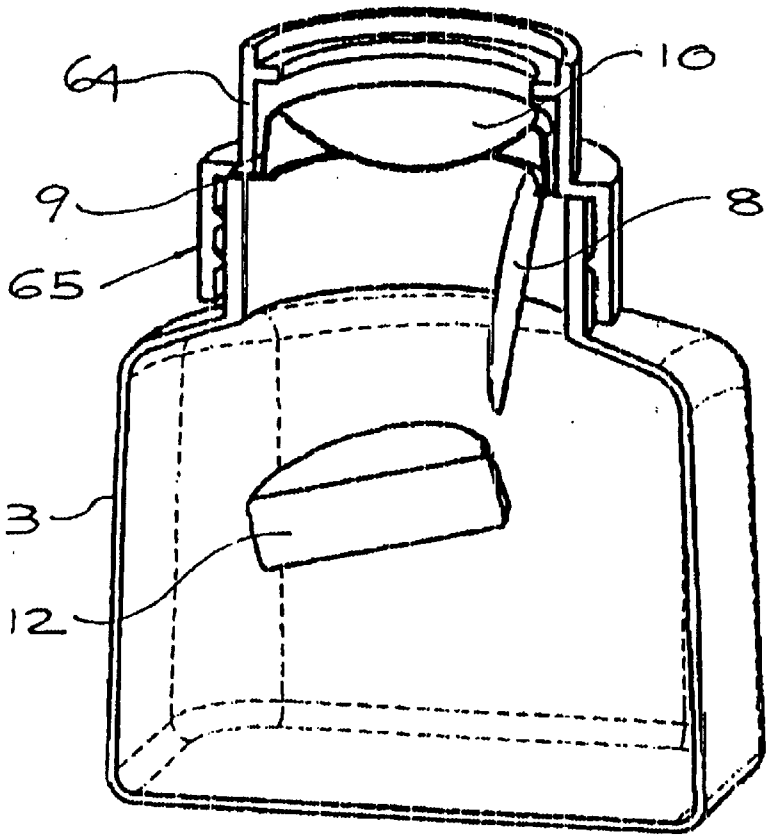
FIG. 9 is the same view as FIG. 8, with the tablet holder broken and the tablet in the container.

To mix the two parts of the drink, the cover 7 is removed. The ring of material 75 is lifted up (FIG. 7). Downward pressure is then applied to the top 10, as described above (FIG. 8). The flange 74 retains the edge 9 in position. Thus after the base 8 has broken, the tablet 12 is forced or dropped into the container 3, mixing with the liquid therein (FIG. 9).

In a further preferred embodiment, the ring of material 75 may be pushed downward, acting in the same manner as the button 45 (of the second preferred embodiment) to push the tablet 12 into the container 3.

Figure 10:
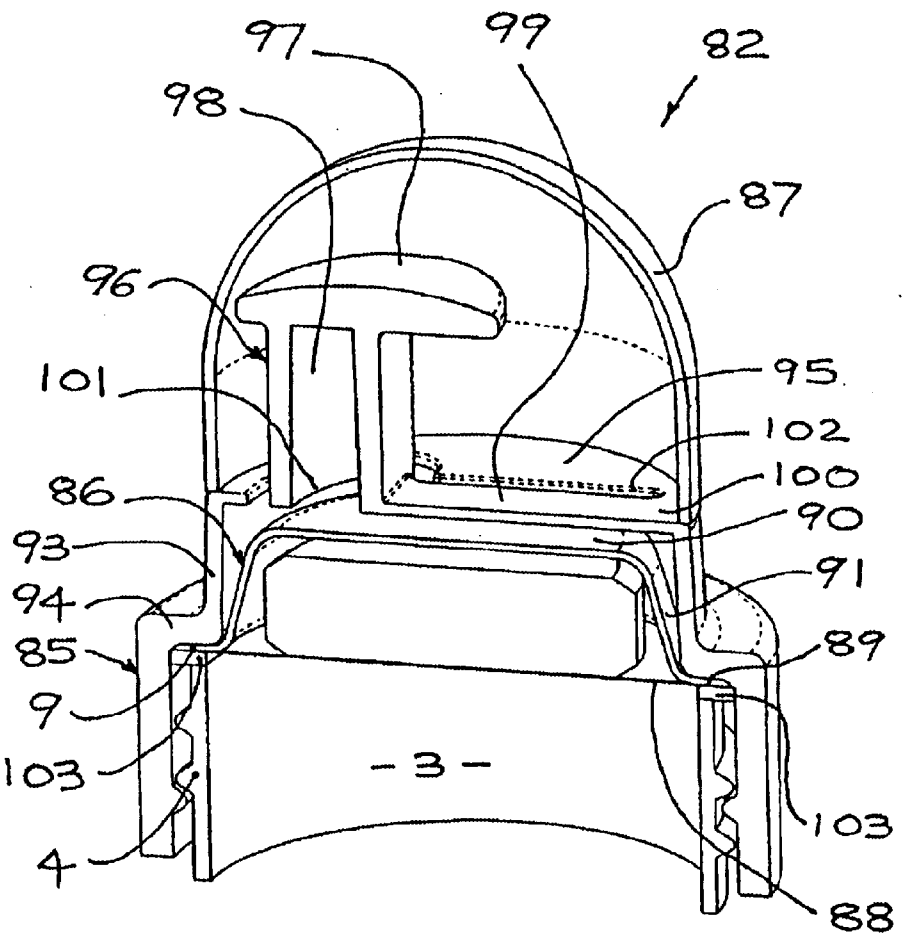
FIG. 10 is a partial perspective side section view of a fourth preferred embodiment of the present invention with the cap closed.

Referring to FIG. 10, a fourth preferred embodiment of the cap 82 for a container 3 is thereshown. The container 3 includes a top opening with external screw threads on sides 4. A collar 85 is internally screw-threaded to engage with the sides 4 of the container 3. The cap 82 includes a tablet holder 86 and cover 87.

The holder 86 includes a base 88 with a thickened circumferential edge 89, and a top 90. The base 88 and edge 89 are flat, with the top 90 having sides 91. The base 88, top 90, and sides 91 define a space for a tablet 12. The base 88 is of a material that has a considerably smaller burst strength than that of the top 90 or the sides 91. The base 88 is made of a foil material, of known type which is impervious to liquid and gases. If so desired, the foil may included a plastic film of known type.

If so desired, the holder 86 may be arranged with the base 88 and top 90 inverted, so that the top 90 is flat and approximately co-planar with the edge 89. The base 88 and sides 91 would then extend downwardly from the top 90.

The edge 89 and the top 90 are of a material that is generally stiffer than the material of the base 88. However the base 88 is also constructed so that there is a measure of flexibility therein.

Figure 11:
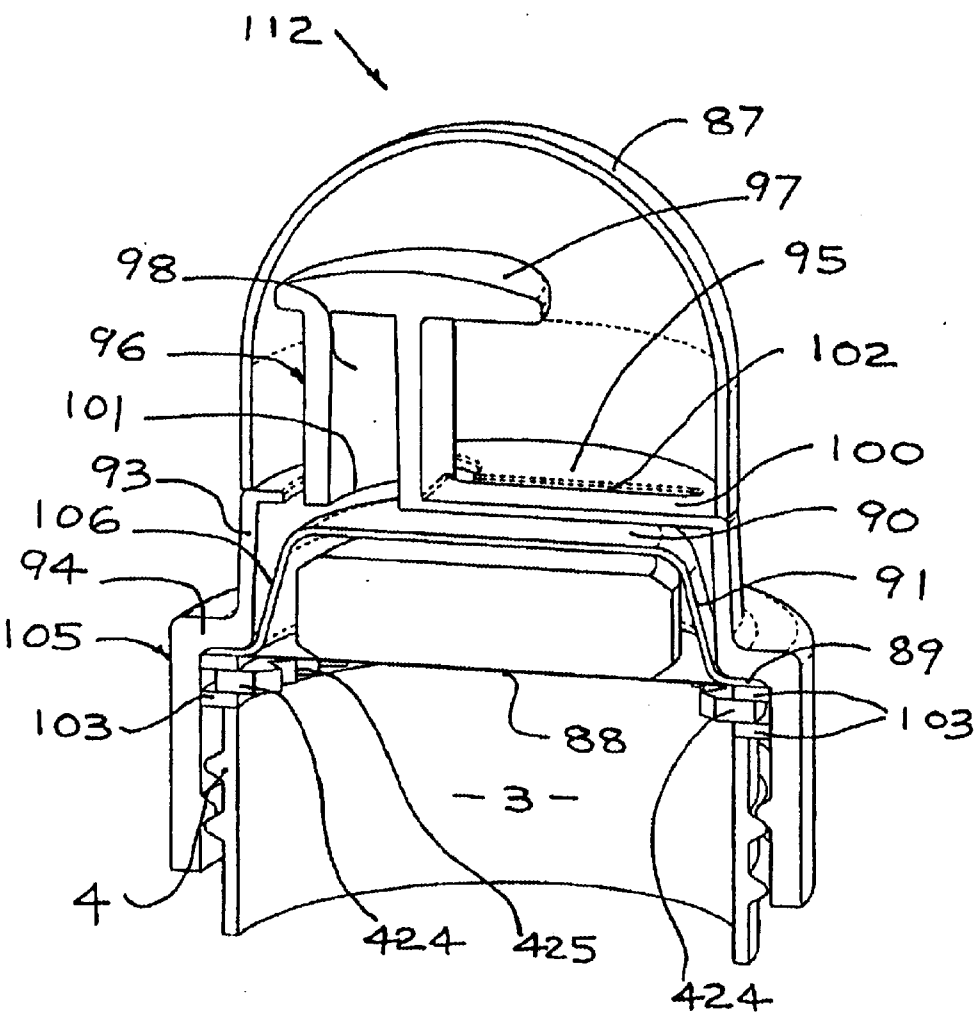
FIG. 11 is a partial perspective side section view of a fifth preferred embodiment of the present invention with the cap closed.
Figure 16:
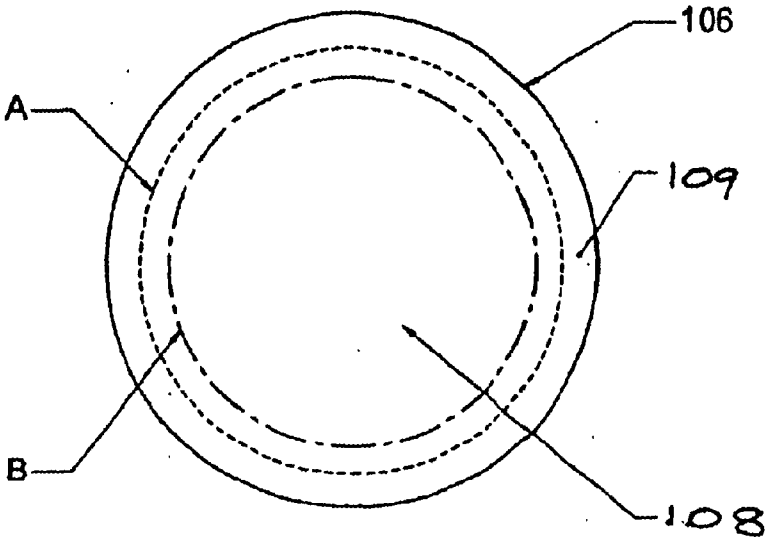
FIG. 16 is a plan view from underneath of a second preferred embodiment of the holder of the present invention.

Referring to FIGS. 11 and 16, a fifth preferred embodiment of the cap 112 includes the holder 106 and is thereshown. The holder 106 includes the same parts as the first embodiment or the fourth embodiment of the holder 86 unless varied as here described. The holder 106 includes a circular area of low burst strength, generally indicated by the dotted line B on FIG. 16. This area B, which is essentially a thin annulus, is inward from the flanged edge 109. The burst strength of the area B is less than that of the remainder of the base 108.

Referring to FIG. 10, the collar 85 includes sides 93 and a smaller, annular flange 94. The flange 94 is dimensioned such that when the collar 85 is in position, it extends inwardly of the top of the sides 4 and of the edge 89. However the hole left in the collar 85 is sufficient that the sides 91 and the top 90 of the holder 86 will fit therethrough.

The cover 87 is shaped to fit over the collar 85 and holder 86 and be releasably securable to the collar 85. This securement can be through securing means (not shown) on the collar 85 and the cover 87; or may be in the form of a snap or interference fit between the collar 85 and the cover 87, as is desired. Further, the cover 87 may be hinged to the collar 85, if so desired.

The collar 85 and the cover 87 may include tamper-evident means (not shown) of known type, if so desired. This may be incorporated into the collar 85 and cover 87 at the time of manufacture. Alternatively, the tamper evident means may be a plastic film (not shown) which is sealed around the collar 85 and the cover 87, covering the join therebetween. Such film is of the type that can be pulled off the container 3, when opening the container 3.

The collar 85 further includes a top 95 which incorporates a pushing lever generally denoted by the numeral 96. The lever 96 includes a thumb-engaging tab 97 which is connected by a column 98 and base 101 to a flexible section 99 of the top 95. The flexible section 99 is formed integrally with a hinging section, which is generally denoted by the number 100. The flexible section 99 and base 101 of the column 98 are separated from the remainder of the top 90 by cut-out slots and curves section 102. The tab 97 may be larger in surface area than the base 101, if so desired.

The collar 85 further includes an annular seal 103. The seal 103, of a flexible plastics such as EVA, is positioned between the top of the container 3 and the flanged edge 99 of the tablet holder (86, 106). The seal 103 may be permanently affixed to the top of the container 3, if so desired. The seal 103 aids in forming a liquid-tight seal between the container 3 and the collar 85. If so desired, the seal 103 may be an O-ring of known type.

Figure 14:
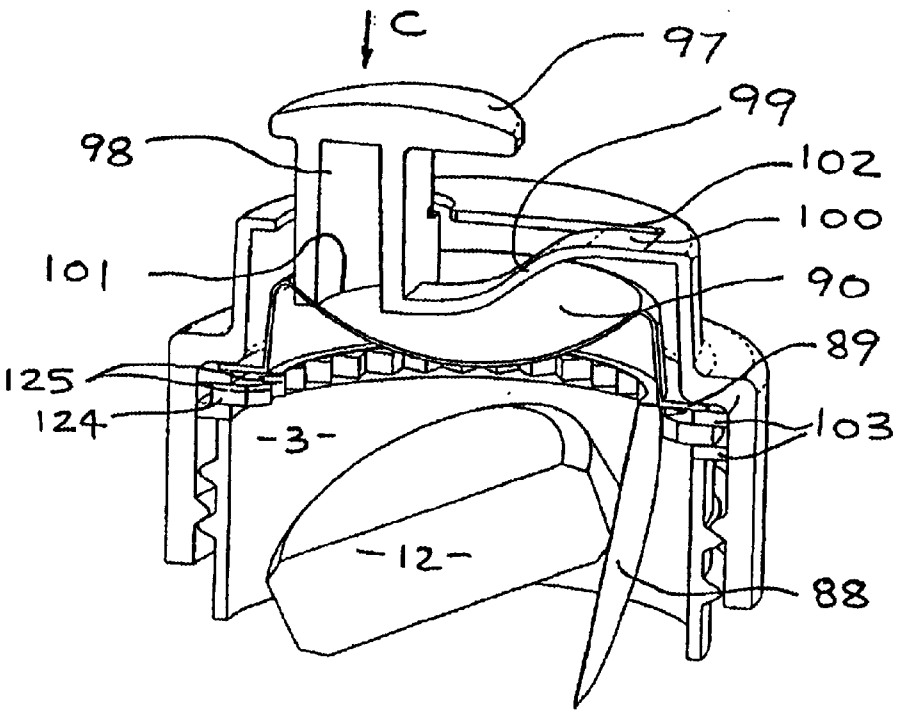
FIG. 14 is the same view as FIG. 11, with the tablet holder broken and the tablet in the container.

The above described embodiment works as follows: To mix the two parts of the drink, the cover 87 is removed. Downward force (in the direction of Arrow C, FIG. 14) exerted on the tab 97 (FIG. 14). This downward pressure is generally supplied by a thumb or other manual means. As the tab 97 is depressed, the base 101 is depressed below the plane of top 95 to engage with the top 90 of the tablet holder 86. The flexible section 99 deforms (FIG. 14), preferably elastically, to operate as a hinging means or hinge section.

The lesser burst strength of the base 88 of the tablet holder 86 causes the base 88 to break before the top 90. The flange 94 retains the edge 99 in position. Thus after the base 88 has broken, the tablet 12 is forced or dropped into the container 3, mixing with the liquid therein. If the second preferred embodiment of the tablet holder 106 is used, the base 88 bursts almost completely along the area B (FIG. 16), allowing the tablet 12 to fall quickly into the container 3.

If so desired, the holder (86, 106) can be constructed so that the tablet 12 is encased in the foil of the base 88 with a circular overlap (not shown) about the outside of the tablet 12. This overlap is then heat sealed or otherwise laminated to the edge 89 to form the holder (86, 106).

The container 3 can be shaken or moved to aid in the mixing of the tablet 12 into the liquid. Once the tablet 12 is completely dissolved, the collar 85 and the remains of the holder (86, 106) can be released from the container 3, allowing access to the drink. The collar 85 and the cover 87 may be re-secured to the container 3, providing for a means to reseal the container 3, if so desired.

Referring to FIG. 11, a fifth preferred embodiment of the cap 112 of the present invention is thereshown. Where parts are unchanged from that discussed above with reference to the fourth embodiment, like numerals are used.

Figure 21A:
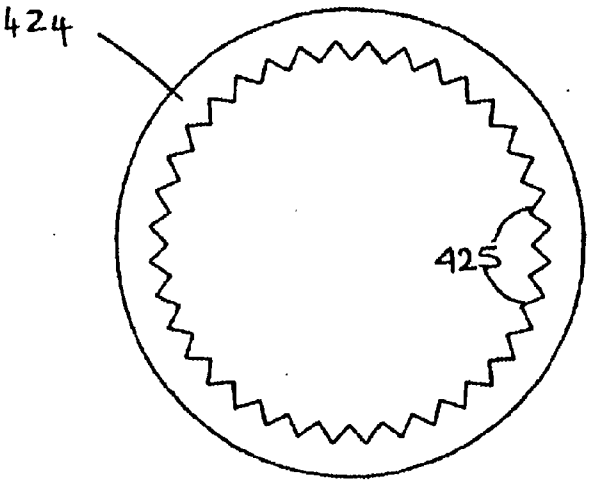
FIGS. 21*a* and *b* show two views of a fourth preferred embodiment of the cutting ring of the present invention.
Figure 21B:
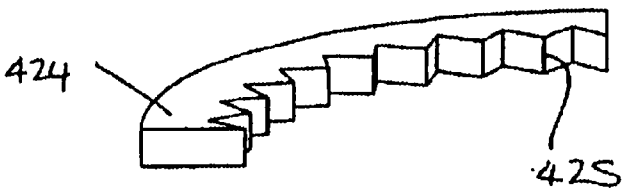

Referring to FIGS. 11 and 21(*a,b*), the collar 105 includes a first preferred embodiment of an annular cutting ring 424. The ring 424 includes a plurality of teeth 425 or saw edgings, giving the ring 424 a saw-tooth appearance. The tips of the teeth 425 are positioned on a circumference which is substantially the same as the circumference of the weakened area B on the tablet holder 106, if the second preferred embodiment of the holder 106 is used. If so desired, the teeth 425 continue around all the circumference of the ring 424. The collar 105 also includes two seals 103, one above and one below the cutting ring 424.

The operation of the collar 105 has only minor variations on that of the first preferred embodiment of the collar 85, except that as the base 101 bears down on the top 90 of the holder (86, 106), the teeth 125 of the ring 124 aid in bursting the base 88 of the holder (86, 106). The ring 124 can be left in place or removed, as is desired, when the holder (86, 106) and collar 105 are removed from the container 3.

Referring to FIGS. 8*a* and *b*, a second embodiment of the cutting ring 224 is thereshown. The inner tip 225 of the ring 224 is a continuous tapered tip around the circumference of the ring 224.

Figure 17A:
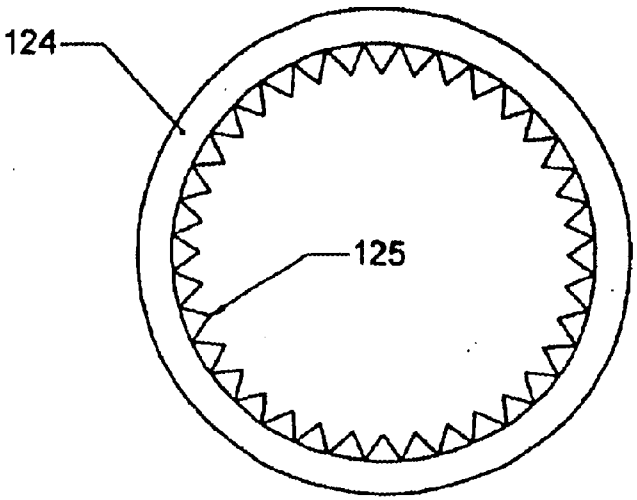
FIGS. 17*a* and *b* show two views of a first preferred embodiment of the cutting ring of the present invention.
Figure 17B:
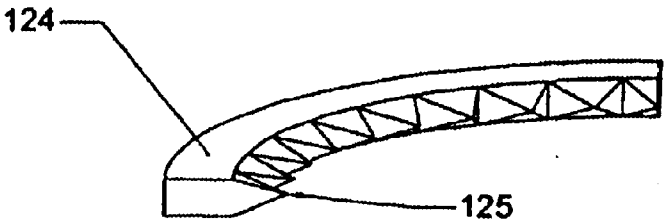
Figure 19A:
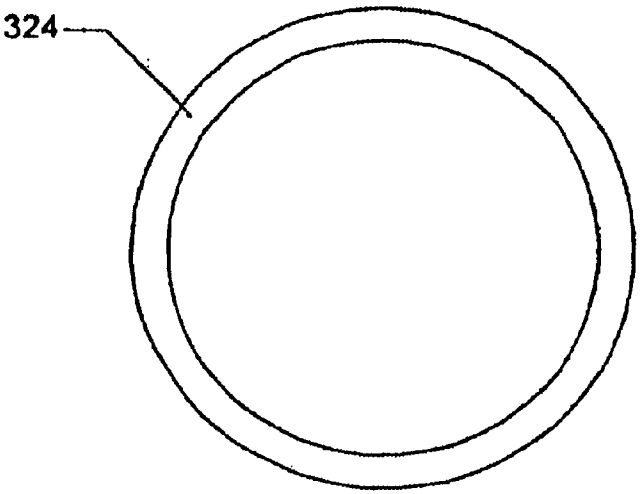
FIGS. 19*a* and *b* show two views of a third preferred embodiment of the cutting ring of the present invention.
Figure 19B:
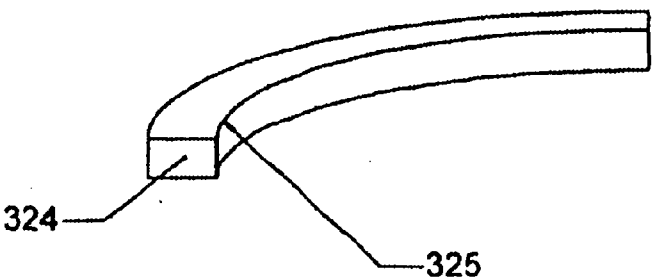
Figure 18A:
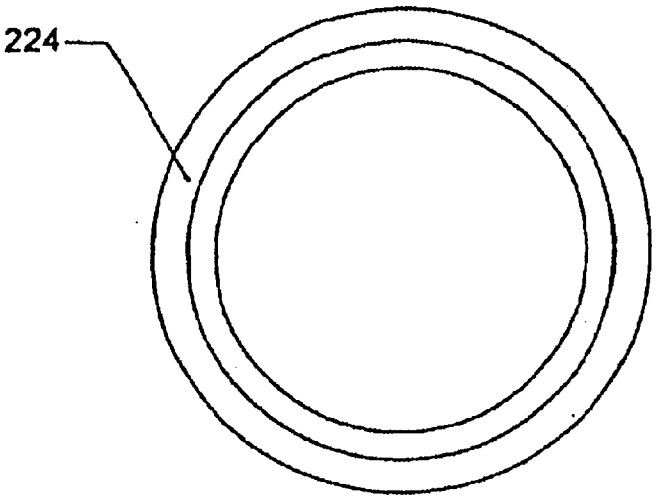
FIGS. 18*a* and *b* show two views of a second preferred embodiment of the cutting ring of the present invention.
Figure 18B:
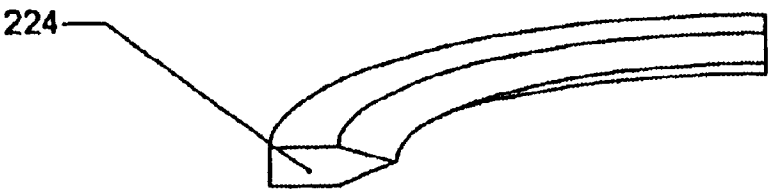

FIGS. 19*a* and *b* show a third preferred embodiment of a cutting ring 324 of the present invention, in which the inner, upper corner 325 of the ring 324 acts as the cutting edge. In like manner, FIGS. 21*a* and *b* show a fourth preferred embodiment of the cutting ring 424 with teeth 425. The major difference between this embodiment and the fourth preferred embodiment of the ring 124 is that the teeth 425 do not taper to a point at the tip as do the teeth 125 (FIGS. 17*a* and *b*).

Figure 12:
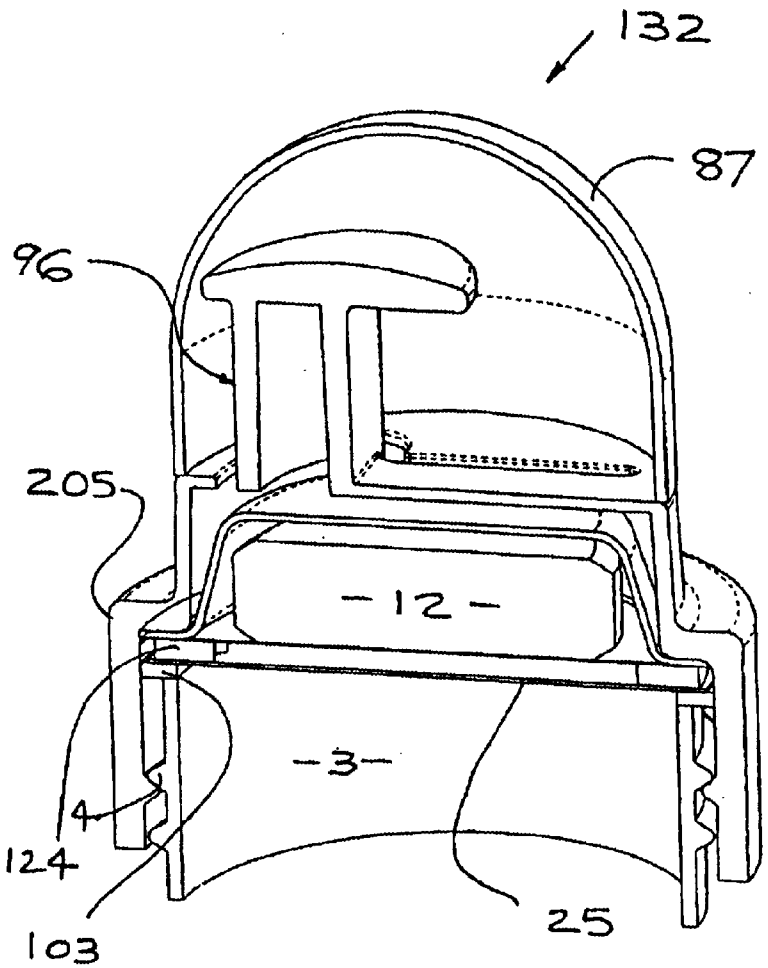
FIG. 12 is a partial perspective side section view of a sixth preferred embodiment of the present invention with the cap closed.

Referring to FIG. 12, a third preferred embodiment of the collar 205 is thereshown in a sixth preferred embodiment of the cap 132 of the present invention. Where parts are unchanged from that discussed above with reference to the fourth embodiment, like numerals are used.

The collar 205 includes a cutting ring 124 and one seal 103. Whilst the ring 124 is shown as the first preferred embodiment of the ring 124, it will be appreciated by one skilled in the field that any of the embodiments of the ring (124, 224, 324, 424) may be used, without departing from the scope of the invention.

Between the ring 124 and the seal 103 is a further, splash guard 25 which is circular in cross-section. If so desired, the guard 25 may be glued or otherwise permanently affixed to either the underside of the ring 124 or the top side of the seal 103, as is desired. The guard 25 is broken by the tablet 12 as it is pushed through into the container 3 by the downward action of the tab 97.

Figure 13:
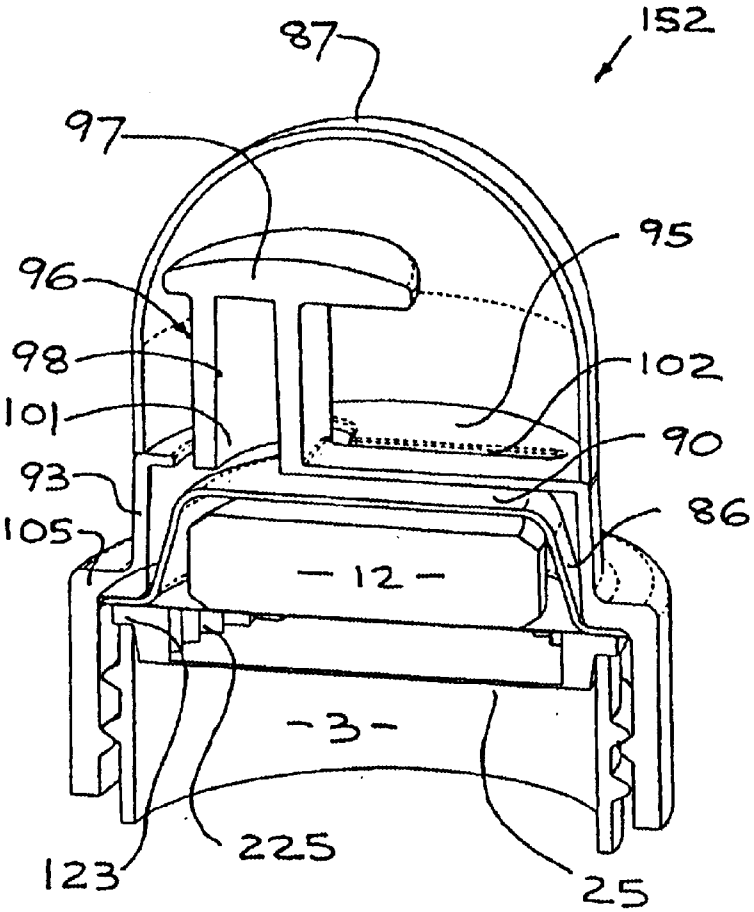
FIG. 13 is a partial perspective side section view of a seventh preferred embodiment of the present invention with the cap closed.

Referring to FIG. 13, a seventh preferred embodiment of the cap 152 of the present invention is thereshown. Where parts are unchanged from that discussed above with reference to the fourth embodiment, like numerals are used.

In this embodiment of the cap 152 the seal and cutting ring are combined into one part, generally denoted by numeral 123. This includes a shoulder of soft flexible material and an inner serrated edge, with teeth 225, of a harder material. If so desired, a splash guard-25 may be incorporated into the embodiment, as described above. The liquid seal is broken in the same manner as described above.

The pushing lever 96 has been described with a circular cross-section. However, it will be appreciated by those skilled in the art that the cross-sectional shape may be other than circular, for example, oval.

Figure 15:
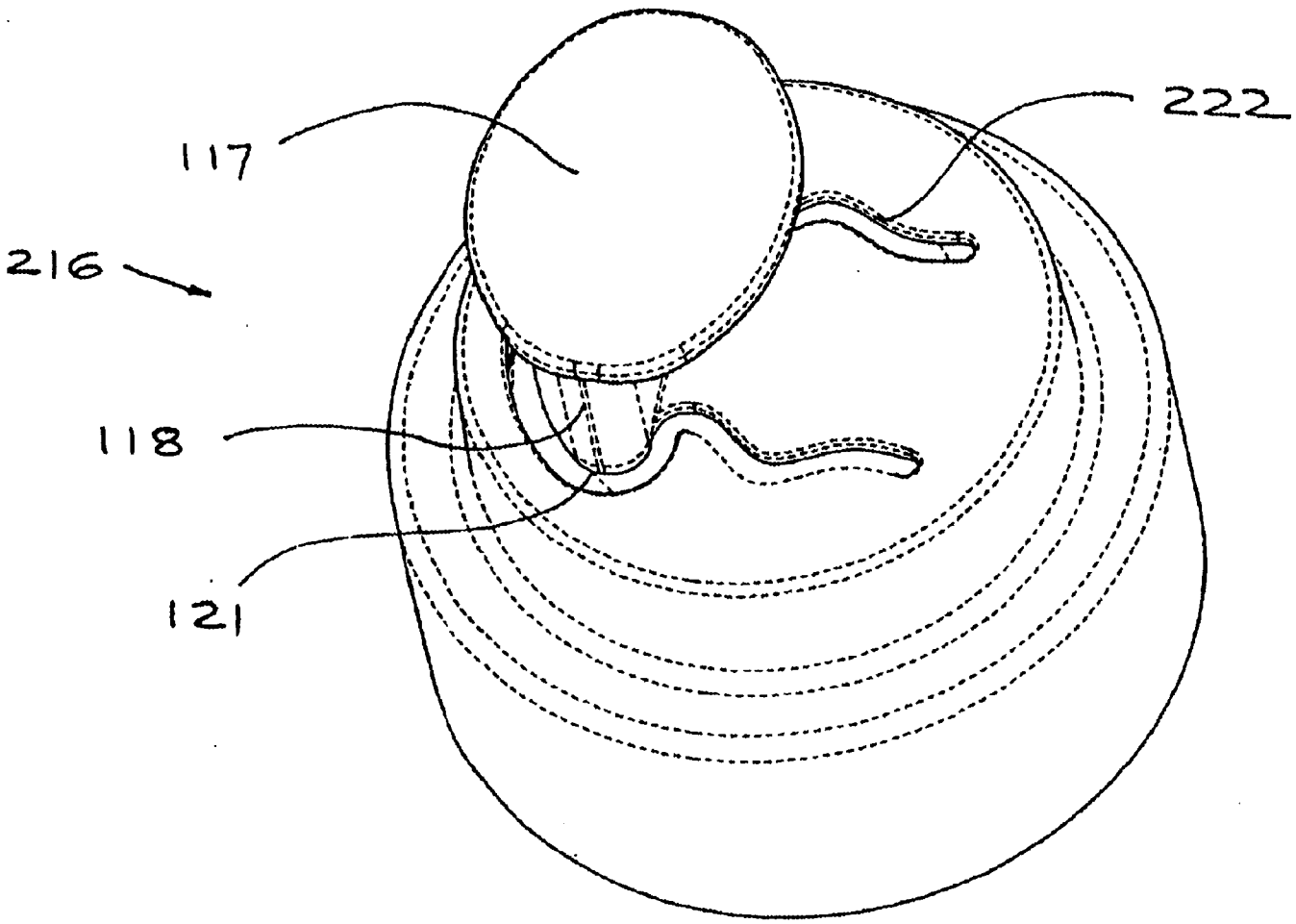
FIG. 15 is a partial top perspective view of a second preferred embodiment of the pushing means of the present invention.

A second preferred embodiment of the pushing lever 216 is shown in FIG. 15. The tab 117, column 118 and base 121 are of oval cross-section. The cut-out section 222 is arcuate and the two sides of the section 222 are not parallel.

Figure 20:
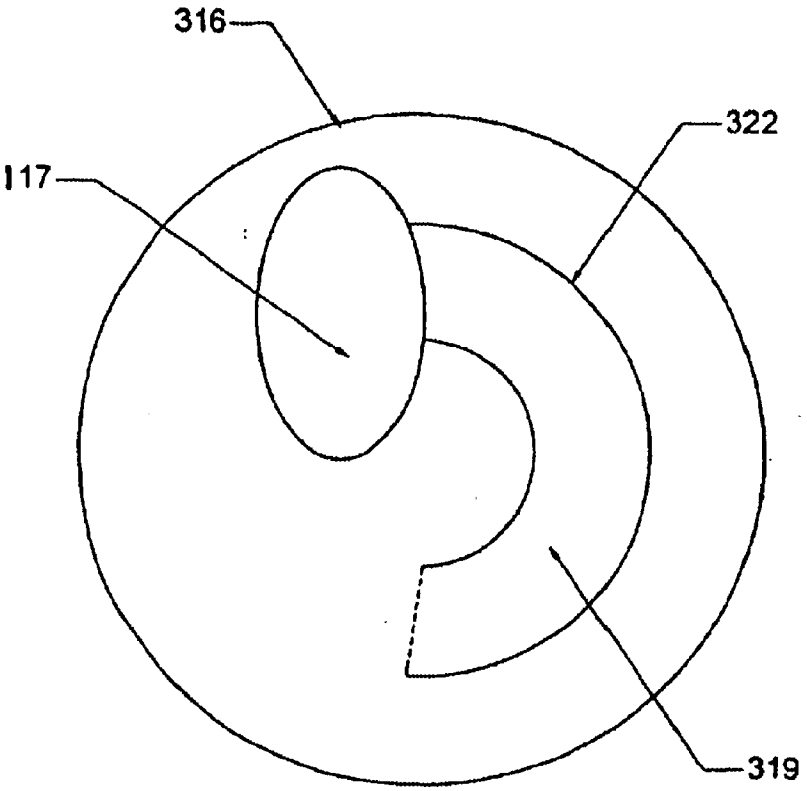
FIG. 20 is a plan view in diagrammatic form of a third preferred embodiment of the pushing lever of the present invention.

A third preferred embodiment of the pushing lever 316 is shown in FIG. 20. The tab 117 is secured to a curved flexible section 319, with curved cut-outs 322.

It will be appreciated by one skilled in the art that the elements of the various embodiments of the pushing lever (96, 116, 216, 316) may be combined in different ways, without departing from the scope of the invention.

All parts of the cap (2, 32, 62 82, 112, 132) are of plastics material. The collar (5, 35, 65, 85, 105,205,305) is formed in one piece, as is the cover (7, 87) and the holder (6, 86,

106). However, if so desired, the components may be formed in more than one piece and later assembled. The seal 103 is preferably of a very flexible plastics or a foam plastics such as EVA, or the like. The ring (124, 224, 324) is preferably of a rigid plastics material.

If so desired, the drink (consisting of the container 3, cap (2, 32, 62, 82, 112, 132), the tablet 12, and water or fluid) can be sold with an additional sipper top (not shown) so that the drink can easily be resealed once ready for drinking. Preferably the tablet 12 is of known type that is effervescent and/or easily dissolvable in water or a liquid.

Also, it will be appreciated that the above described holder (6, 86, 106) is a 'use once' variety. However, the remaining elements of the cap (2, 32, 62, 82, 112, 132) and container 3 may be refused, if so desired. However, the materials and construction of these components are of such a nature that the cap (2, 32, 62, 82, 112, 132) and container 3 may be for a use once drink, at a reasonable price for the overhead of the cost of the container 3 in the cost of the drink.

The invention has been discussed above with a number of embodiments for the collar (5, 85, 105, 205, 305) and the pushing lever (96, 216, 316), it will be appreciated that these may be used in various combinations from the range of embodiments, without departing from the scope of the invention.

Aspects of the present invention have been described by way of example only and it should be appreciated that modifications and additions may be made thereto without departing from the scope thereof.

What is claimed is:

1. For a container having an opening with a rim, a cap for retaining a product to be released into the container as desired, the cap comprising:

a holder having a flexible top and a membrane-like base sealed together about a common circumferential edge to envelop the product;

a collar removably fixable about the opening, the collar having a flange for abutting the circumferential edge to fix the holder between the flange and the rim of the container, the base being positioned inwardly of the flexible top to provide a liquid impermeable seal over the opening;

a cutting edge positioned inwardly of the base to circumscribe at least a part of the product; and configured such that when pushed inwards, the top of the holder deforms to press the base of the holder against the cutting edge, cutting open the base to release the product into the container; the opening being sealed by means of the top after the base has been cut open; and such that after the collar has been removed, the opening is resealable by the top when the collar is replaced.

2. The cap of claim 1 wherein the cutting edge is formed in a saw tooth pattern.

3. The cap of claim 1 wherein the cutting edge is formed on a cutting ring fixed between the rim and the base.

4. The cap of claim 1 further including a removable cover extending over the top of the holder for preventing unwanted opening of the base of the holder.

5. The cap of claim 1 further including a digit-engaging element fixed to the collar outwardly of the top of the holder, wherein the digit-engaging element contacts the top, deforming the top to press the base of the holder against the cutting edge, cutting open the base to release the product into the container.

6. The cap of claim 5 further including an outer side portion covering the top of the holder, and wherein the digit-engaging element is formed integrally with the collar and includes a button fixed to a resilient hinge formed by a cut-out section of the outer side portion.

7. The cap of claim 6 wherein the button is formed at the end of a pedestal fixed to the resilient hinge.

8. The cap of claim 1 wherein the base includes an annular section of reduced strength at least partially circumscribing the product.

9. The cap of claim 1 further including a second membrane extending over the opening and positioned inside the base and having a rupture strength equal to or less than that of the base.

10. The cap of claim 1 further including an annular seal for sealing engagement with the rim.

11. The cap of claim 1 wherein the collar is internally threaded for engagement with a externally threaded neck surrounding the opening of the container.

12. The cap of claim 1 wherein a liquid drink component is held in the container, and the product is in the form of a tablet.

13. An apparatus for retaining a product to be released into a container as desired, including a container having an opening with a rim and a cap removably fixable to the container to close the opening, the cap comprising:

a holder having a flexible top and a membrane-like base sealed together about a common circumferential edge to envelop the product;

a collar removably fixable about the opening, the collar having a flange abutting the circumferential edge to fix the holder between the flange and the rim of the container, the base being positioned inwardly of the flexible top to provide a liquid impermeable seal over the opening;

a cutting ring positioned inwardly of the base, the cutting ring having a cutting edge circumscribing at least a part of the product; and configured such that when pushed inwards, the top of the holder deforms to press the base of the holder against the cutting edge, cutting open the base to release the product into the container; the opening being sealed by means of the top after the base has been cut open; and such that after the collar has been removed, the opening is resealable by the top when the collar is replaced.

14. The apparatus of claim 13 wherein the cutting edge is formed in a saw tooth pattern.

15. The apparatus of claim 13 further including a removable cover extending over the top of the holder for preventing unwanted opening of the base of the holder.

16. The apparatus of claim 15 wherein the cap further includes a digit-engaging element fixed to the collar outwardly of the top of the holder, the digit-engaging element contacting the top, deforming the top to press the base of the holder against the cutting edge, thereby cutting open the base to release the product into the container.

17. The apparatus of claim 16 wherein the cap further includes an outer side portion to cover the top of the holder, and wherein the digit-engaging element is formed internally with the collar and includes a button fixed to a resilient hinge formed by a cut-out section of the outer side portion.

18. The apparatus of claim 17 wherein the button is formed at the end of a pedestal fixed to the resilient hinge.

19. The apparatus of claim 18 further including a second membrane extending over the opening and positioned inside the base and having a rupture strength equal to or less than that of the base.

20. The apparatus of claim 19 further including an annular seal of sealing engagement with the rim.

21. The apparatus of claim 20 wherein the cap includes an internally threaded collar for engagement with a corresponding externally threaded neck surrounding the opening of the container.

22. The apparatus of claim 21 wherein a liquid drink component is held in the container, and the product is in the form of a tablet.

23. An apparatus for retaining a product to be released into a container as desired, including a container having an opening with a rim and a cap removably fixable to the container to close the opening, the cap comprising:

a holder having a flexible top and a membrane-like base sealed together about a common circumferential edge to envelop the product;

a collar removably fixable about the opening, the collar having a flange abutting the circumferential edge to fix the holder between the flange and the rim of the container, the base being positioned inwardly of the flexible top to provide a liquid impermeable seal over the opening;

a cutting ring positioned inwardly of the base, the cutting ring having a serrated cutting edge circumscribing at least a part of the tablet;

a removable cover extending over the top of the holder for preventing unwanted opening of the base;

a pusher formed in an outer side of the cap covering the top of the holder, the pusher being in the form of a resilient hinge formed by a cut-out section of the outer side, and adapted such that when pushed inwards, the pusher contacts the top, deforming the top to press the base of the holder against the cutting edge, cutting open the- base to release the product into the container; the opening being sealed by means of the top after the base has been cut open; and such that after the cap has been removed, the opening is resealable by the top when the cap is replaced.

* * * * *